US005361717A

United States Patent [19]

Kobayashi

[11] Patent Number: 5,361,717

[45] Date of Patent: Nov. 8, 1994

[54] WATER VEHICLE WITH A SWINGABLE COVER

[75] Inventor: Noboru Kobayashi, Iwata, Japan

[73] Assignee: Yamaha Hatsudoki Kabushiki Kaisha, Iwata, Japan

[21] Appl. No.: 97,560

[22] Filed: Jul. 26, 1993

[51] Int. Cl.[5] ..... B63B 17/00

[52] U.S. Cl. ..... 114/361

[58] Field of Search ..... 114/361, 343, 270

[56] References Cited

U.S. PATENT DOCUMENTS

| | | | |
|---|---|---|---|
| 3,035,281 | 5/1962 | Pearson | 114/361 |
| 3,123,839 | 3/1964 | Reid | 114/361 |
| 3,161,895 | 12/1964 | Lewis | 114/361 |
| 3,434,166 | 3/1969 | Clymer | 114/361 |
| 3,797,436 | 3/1974 | Moore | 114/361 |
| 3,805,724 | 4/1974 | Butler | 114/361 X |

*Primary Examiner*—Sherman Basinger

*Attorney, Agent, or Firm*—Knobbe, Martens, Olson & Bear

[57] ABSTRACT

A small watercraft having a generally open passengers area with a cowling portion that is movable between a position closing the forward portion of the passengers area and a forwardly extending deck and a raised position to access the passengers area to provide at least a partial cover over it. In one embodiment the cowling portion also covers a centrally positioned joy stick and in another embodiment the watercraft control is mounted on the cowling portion.

21 Claims, 7 Drawing Sheets

WATER VEHICLE WITH A SWINGABLE COVER

BACKGROUND OF THE INVENTION

This invention relates to an improved water vehicle and more particularly to a swingable cover therefore.

In a wide variety of types of water vehicles it is desirable to provide a generally open passenger area in which one or more passengers may be accommodated. There are instances, however, where it is desirable to provide a cover that may cover the passengers area to afford shelter or protection to the passengers therein. However, if the cover is easily movable into that position, it also must be storable in a position wherein it will not provide an unsightly appearance and, preferably, wherein it performs a function in each position.

It is, therefore, a principle object of this invention to provide an improved swingable cover for a watercraft.

It is a further object of this invention to provide a swingable cover for a watercraft that can provide a cover for the passengers area but which also forms a continuous surface for the remaining hull of the watercraft when not in its protecting position.

The problems of providing such covers are particularly significant in connection with small watercraft of the type called "personal watercraft". This type of watercraft has relatively small passengers compartment and the hull is itself also very small and compact. Although it is desirable to provide a rigid cover for the aforenoted purposes, this is particularly difficult with such small personal watercraft.

It is, therefore, a still further object of this invention to provide a movable cover for a personal watercraft.

As has been previously noted, it is desirable to provide a generally open passenger area for the occupants of the watercraft. However, it is also desirable to at least partially enclose this passengers area so as to afford protection to the passengers. However, such enclosed passenger compartment may provide disadvantages under some instances.

For example, the partial enclosure of the passengers area may make it difficult to enter or exit the watercraft. In addition, the partial enclosure may make it difficult to utilize the watercraft for such sporting purposes as fishing or the like when the cover is in position.

It is, therefore, a still further object of this invention to provide an improved cover for a watercraft that at least partially closes the passengers compartment but which is easily movable to a position wherein access is afforded.

SUMMARY OF THE INVENTION

A first feature of this invention is to be embodied in a watercraft that is comprised of a hull defining a passengers area. A cover portion is supported by the hull for movement from a first position when the cover portion forms a continuation of a portion of the hull and a second position wherein the cover portion forms at least in part a cover over the passengers area.

Another feature of the invention is also adapted to be embodied in a watercraft that has a hull which defines a passengers area with a deck area at one end of the passengers area. A cowling portion is supported by the hull for movement from a first position which forms a raised area thereupon and which partially overlies and encloses a portion of the passengers area and a raised positioned above the deck and opening the enclosed portion of the passengers area for access.

DETAILED DESCRIPTION OF THE PREFERRED EMBODIMENTS OF THE INVENTION

Figure 1:
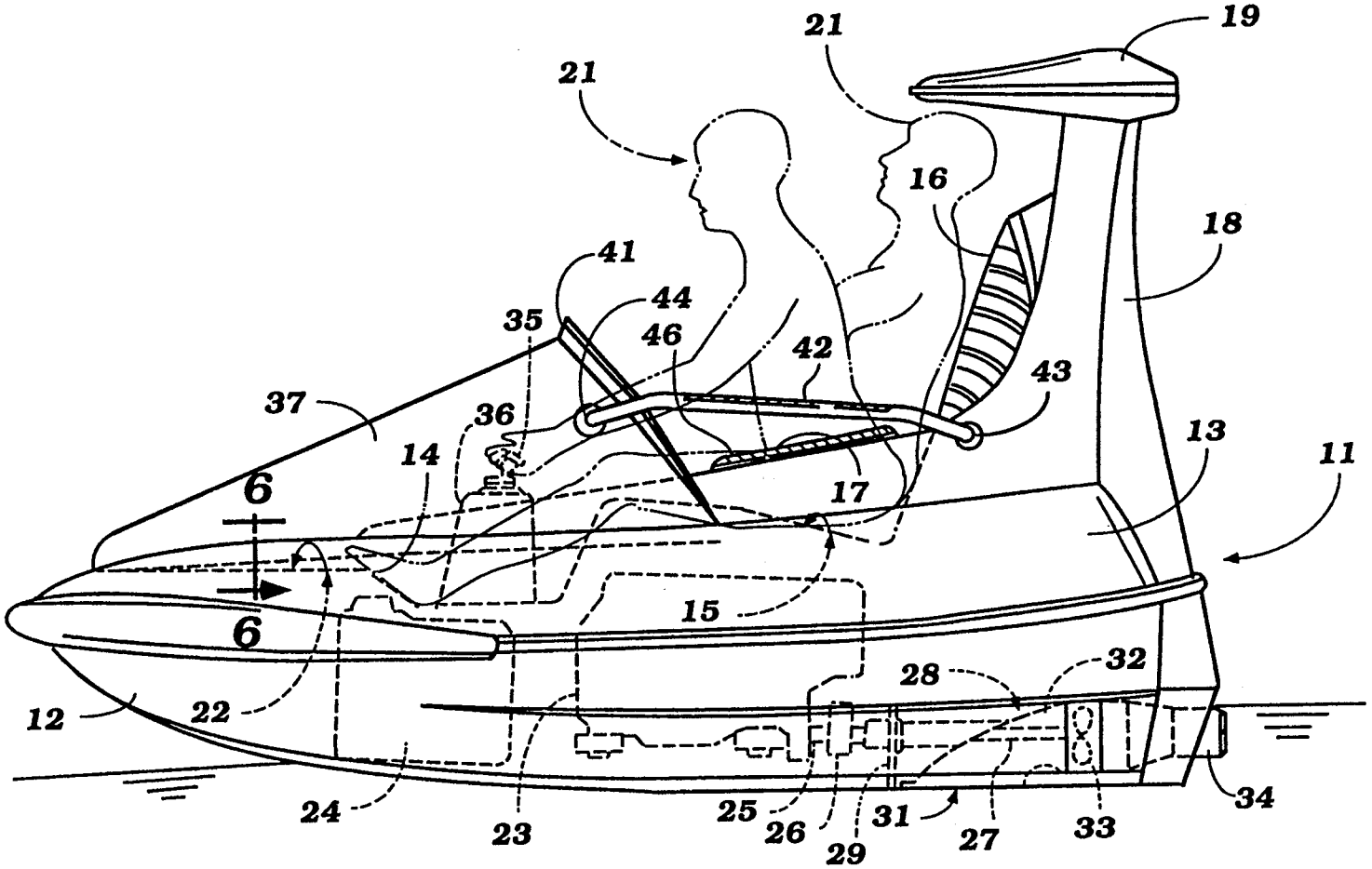
FIG. 1 is a side elevational view of a small watercraft constructed in accordance with a first embodiment of the invention and shows the cover in a first position.
Figure 2:
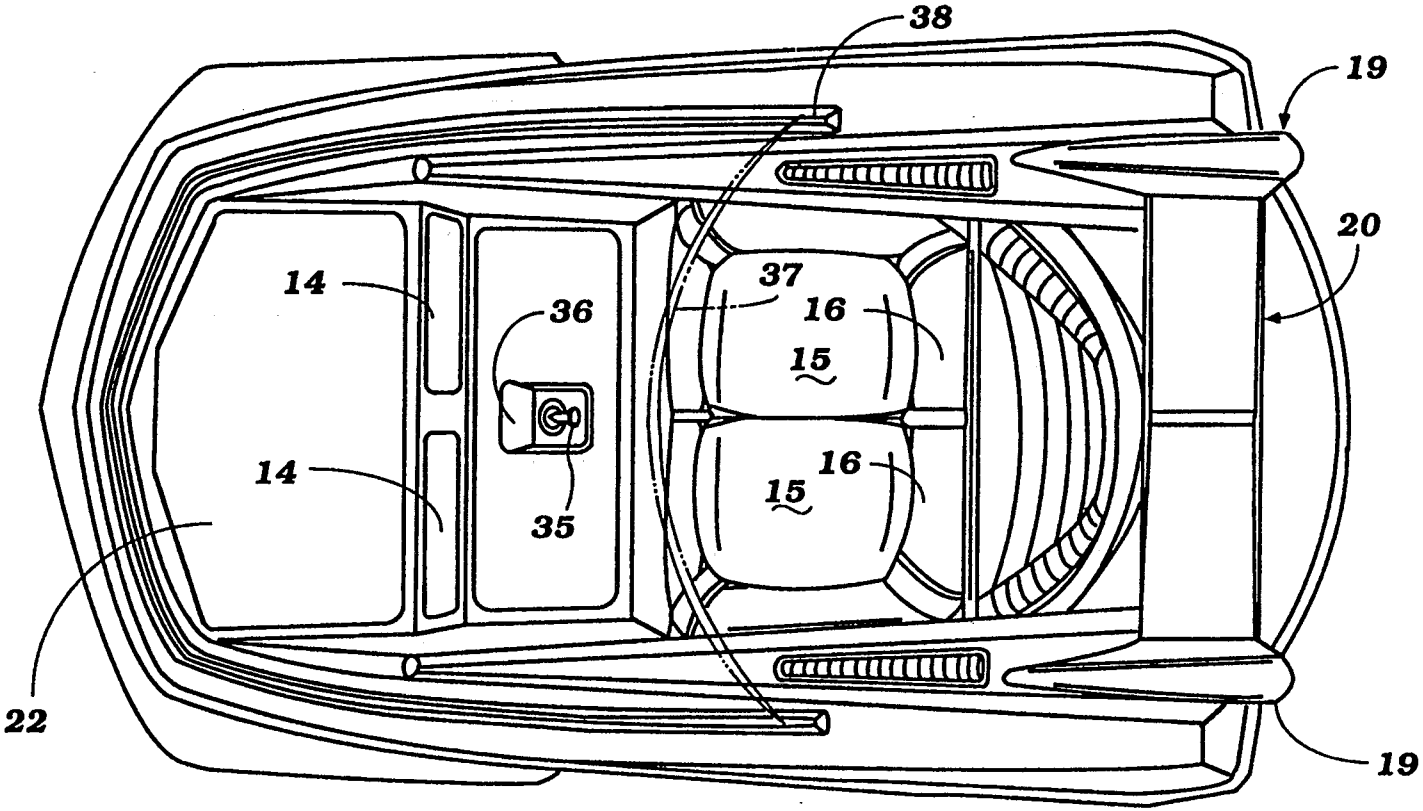
FIG. 2 is a top plan view of the watercraft with the moveable cover shown in phantom to more clearly show the construction.

A small watercraft constructed in accordance with the first embodiment of the invention is shown in detailed in FIGS. 1 through 6 and is identified by the reference numeral 11. The watercraft 11 is comprised of a hull consisting of a lower hull portion 12 and an upper deck portion 13. The hull portions 12 and 13 are formed from a suitable material such as a molded fiberglass reinforced resin or the like and are affixed to each other in any suitable matter around their outer peripheries.

The deck portion 13 forms a passengers compartment which extends from a forward toe area 14 rearwardly to a pair of side by side seats 15 which extend to backrest 16 positioned at the rear portion of the watercraft 11. The seats 15 and backrest 16 are adapted to accommodate either one rider seated centrally or a pair of riders seated in side by side fashion. It should be noted that, except for a pivotal cover which will be described, this riders compartment is generally open.

The sides of the riders area are defined by a pair of raised gunnels 17 which terminate at their rear end in a pair of upstanding pillars 18 having portions 19 across which a cross bar 19 is positioned. When a rider, indicated generally by the reference numeral 21 leans against the backrest 16 his head will be partially beneath the cross bar 19.

A generally flat deck are 22 is provided forwardly of the toe areas 14 to assist in the front entry of the watercraft 11, in a manner which will be described.

The hull is formed with a generally open cavity between the hull portion 12 and the deck portion 13 with an internal combustion engine, indicated generally by the reference numeral 23 and of any known type, being positioned beneath the seats 15. A fuel tank 24 for the engine 23 is positioned in this cavity forwardly of the engine 23. Suitable removable panels, such as the seat bottoms 15 may be provided so as to access the engine 23. In addition, the fuel tank 24 may be provided with an exposed filler neck (not shown) so as to permit fueling of the watercraft 11.

The engine 23 has an output shaft 25 that is coupled by means of a flexible coupling 26 to an impeller shaft 27 of a jet propulsion unit, indicated generally by the reference numeral 28 and which is positioned within a tunnel formed on the underside of the rear of hull portion 12 and which terminates at a forward bulkhead 29 through which the impeller shaft 27 extends.

The jet propulsion unit 28 may be of any know type and includes a downwardly facing water inlet opening 31 through which water is drawn by via inlet passage 32 by an impeller 33 that is affixed to the impeller shaft 27. This water is then discharged rearwardly through a pivotally supported steering nozzle 34 for propelling the watercraft 11 in a well known manner.

A joy stick 35 is mounted rearwardly of the toe area 14 and forwardly of the seats 15 on a control pillar 36 for controlling the speed of the engine 23 and the pivotal position of the steering nozzle 34 so as to provide control for the watercraft. By using the centrally positioned joy stick 35 the watercraft may be controlled by either a single rider seated centrally on the seats 15 or either one of two riders seated in side by side fashion.

Although the open passengers compartment permits the riders to engage such activities as fishing or the like and also facilitates boarding of the watercraft 11 either from a body of water in which the watercraft is operating, from a dock or when partially beached, there is little protection for the riders when traveling. Therefore, the watercraft 11 is provided with a protective cowling or cover, indicated generally by the reference numeral 37 which is formed from a suitable rigid material such as molded fiberglass reinforced resinous plastic material or the like. The cowling 37 is normally mounted in a recess 38 formed in the upper periphery of the deck portion 13 as clearly shown in FIG. 6 and a suitable water tight seal 39 may be carried at the lower end of the recess 38 so as to provide a water tight seal. Also, as may be readily apparent from FIG. 1, the cowling 37 is essence forms an extension of the surface of the deck portion 13 and terminates in a flared wind deflector 41 so as so to afford protection for the riders 21. However, the cowling 37 has sufficient height as to readily permit operation of the joy stick 35 as may be seen in FIG. 1.

Figure 3:
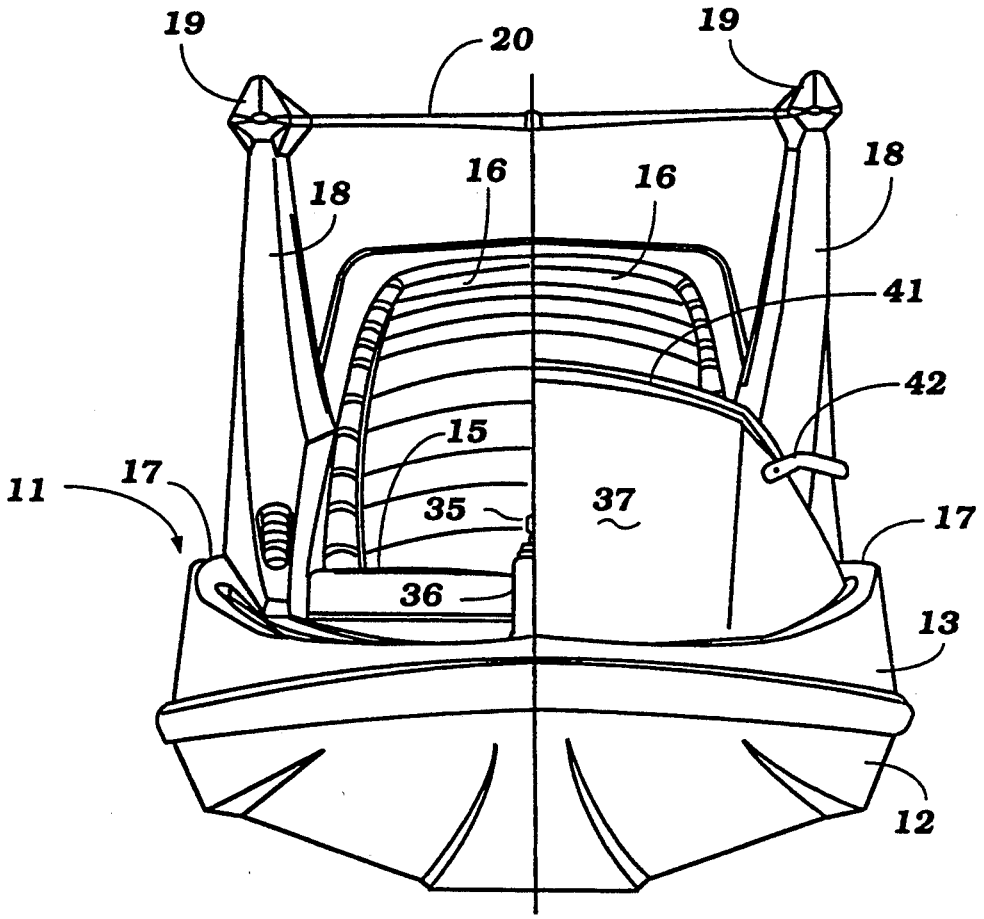
FIG. 3 is a split view front elevational view showing the watercraft with cover removed on the left hand side and with the cover in one position on the right hand side.
Figure 4:
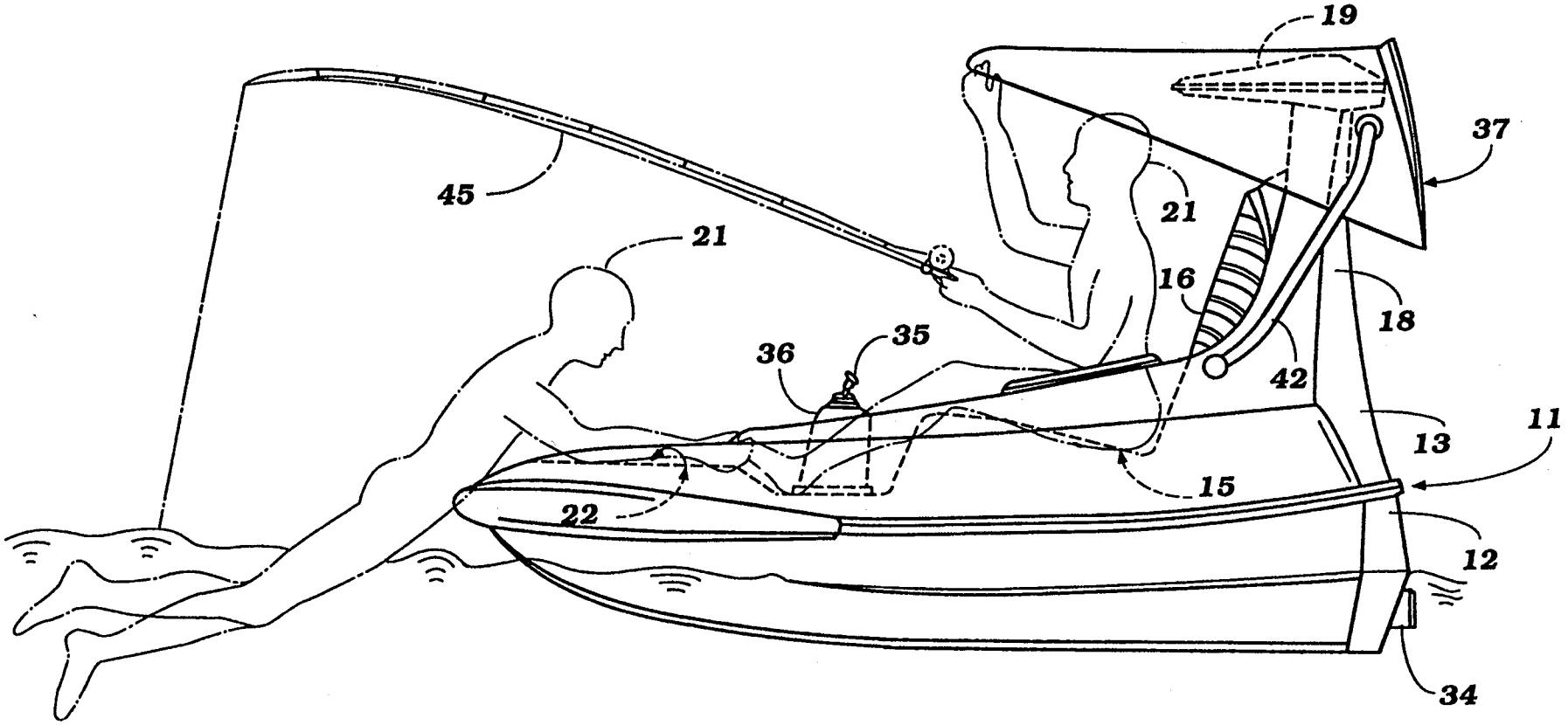
FIG. 4 is a side elevational view, in parts similar to FIG. 1, and shows the cover in a position covering the passengers compartment and affording ease of access and greater utility for the watercraft.
Figure 5:
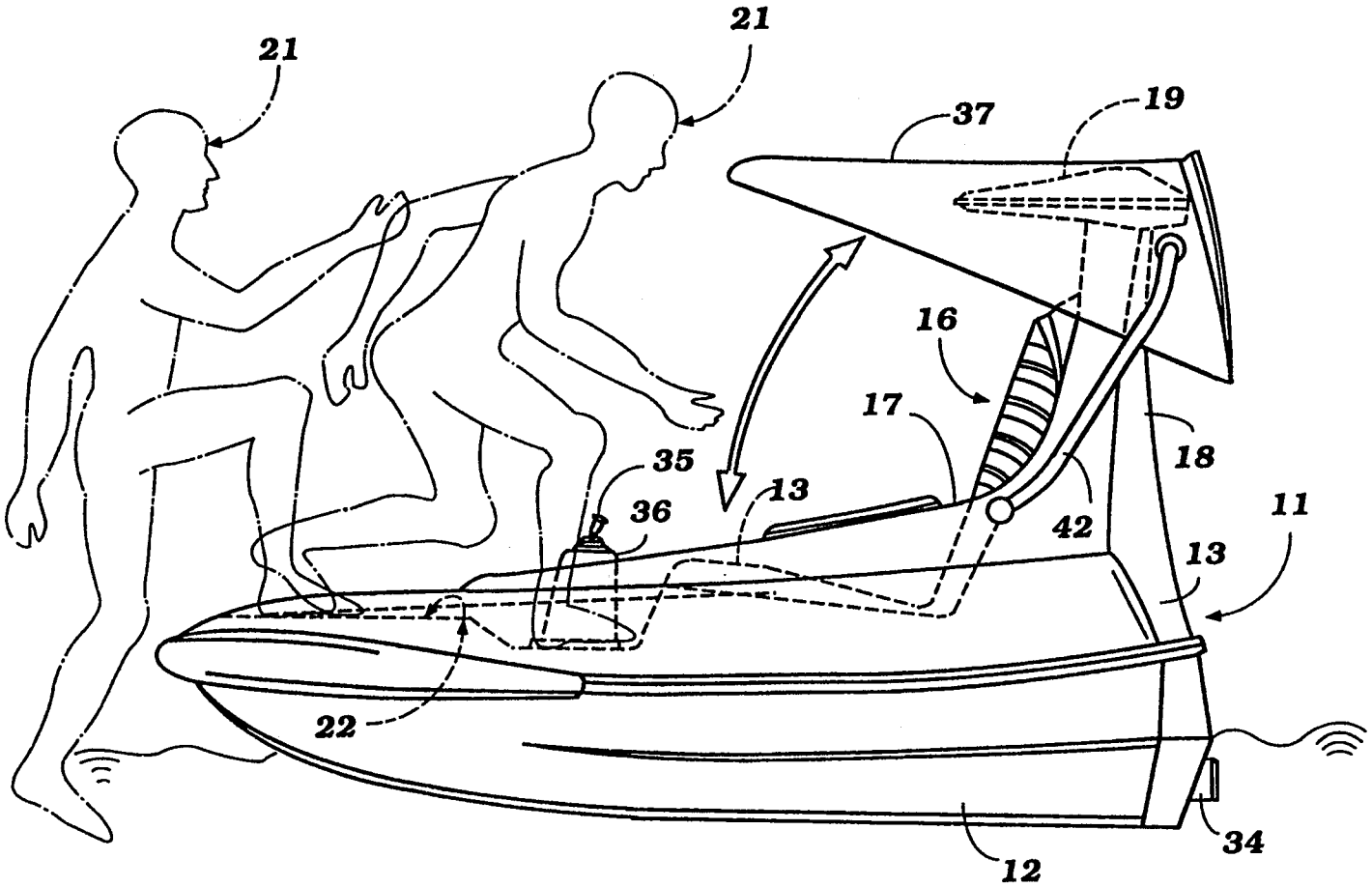
FIG. 5 is side elevational view, in part similar to FIG. 4, and shows how the watercraft can be easily reentered with the cover in this position.
Figure 6:
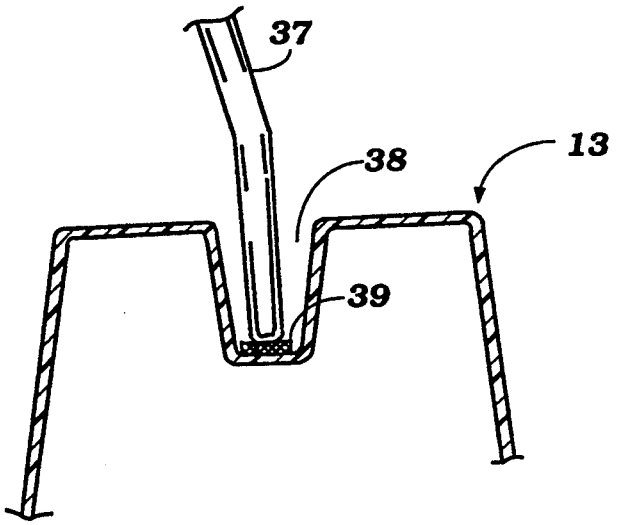
FIG. 6 is a cross-sectional view taken along the line 6—6 of FIG. 1 and shows how the cover provides a water tight seal when in this position.

In order to permit ease of entry and exit from the watercraft 11, however, the cowling 37 is supported for movement from its normal position as shown in FIG. 1 and in the right hand side of FIG. 3 to a raised position by means of a pair of side links 42 that have pivotal connections 43 at their rear end to the raised gunnel portion 17 and pivotal connections 44 and their forward ends to the sides of the cowling 37. As such, the cowling 37 may be easily raised to a position above the cross bar 19 so as to not only provide an extension of the cross bar 19 as shown in FIG. 4 so that the riders may easily fish with a fishing pole, as indicated by the reference numeral 45 in this Figure and also so as to enter into the deck area 22 from the body of water in which the watercraft is operating as also shown in this Figure. Also, the riders may enter the watercraft from a dock or if the watercraft is beached as shown in FIG. 5. In addition to affording ease of access, when the cowling 37 is in its raised portion it also offers addition shelter for the operator.

The connection between the links 42 and the cowling 37 may be such so as to minimize pivotal movement of the cowling 37 about the pivotal connection 44 or the mechanism may operate like parallelogram linkage system so as to maintain the cowling 37 in a generally parallel position during its pivotal movement. Any known structures may be employed for this purpose. Also locks (not shown) are provided for locking the cowling 37 in each position. In either position the links 42 will act as grab handles.

It should also be noted that the gunnel 17 on the side of the seat 15 may be provided with padding 46 so as to offer a cushion for the riders arms.

Figure 7:
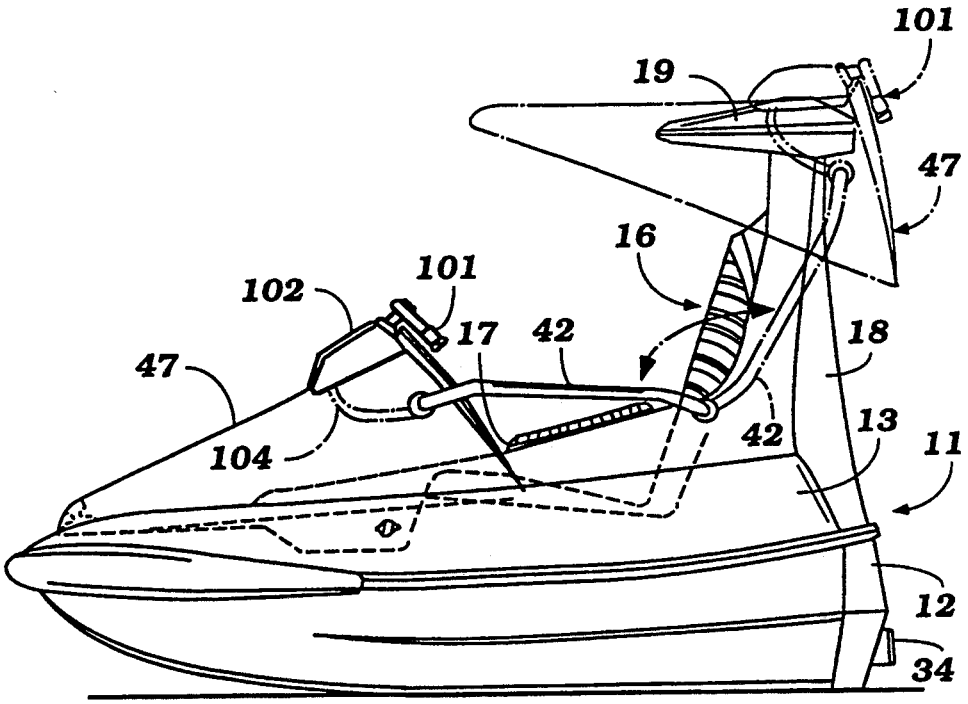
FIG. 7 is side elevational view, in part similar to FIG. 1 and shows another embodiment of the invention with the cover in a first position and solid line views and in a second position in a phantom line view.
Figure 8:
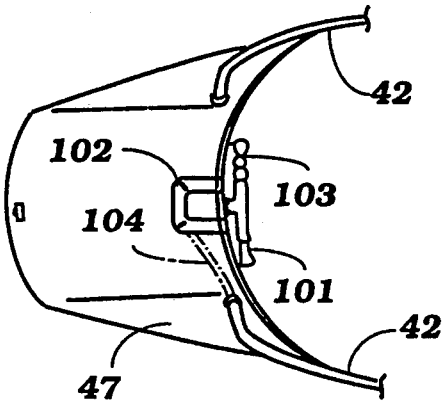
FIG. 8 is partial top plan view showing the cover and the control carried by it.

FIGS. 7 and 8 show another embodiment of the invention which is generally the same as the embodiment of FIGS. 1 through 6 and, for that reason, only two views are believed necessary to illustrate this embodiment and components which are substantially the same as those previously described have been identified by the same reference numerals. This embodiment differs from the previously described embodiment only in the control for the watercraft and the mounting therefore.

In this embodiment, a handle bar assembly 101 is mounted by means of a mounting bracket 102 on the protective cowling 37. The handle bar assembly 101 also includes a motorcycle type throttle control 103 with both the steering handle 101 and throttle 103 being connected to a pair of bowden wire actuators 104 that extend through the hollow tubular interior of one of the links 42. Alternatively, the steering wire may pass through one link 42 and the throttle wire may pass through the other link 42. With this embodiment, the handle bar assembly 101 is also centrally position for operation by a single centrally positioned operator or by either of two side by side riders. The bowden wire actuators 104 permit the cowling 47 to be moved between its lower position as shown in solid line views in FIG. 7 and its elevated position as shown in phantom line view in this Figure without causing the steering nozzle 34 to pivoted or the throttle to be operated.

It should be readily apparent from the foregoing description that the described embodiments of the invention are effective in providing a watercraft that may be easily entered even though it is quite small or may be used for utilitarian purposes when stationary but which also provides good protection for the riders when traveling through the water. Of course, the foregoing description is that of preferred embodiments of the invention and various changes or modifications may be made without departing from the spirit and scope of the invention, as defined by the appended claims.

I claim:

1. A watercraft comprised of a hull defining a passengers area, said hull comprising a deck portion forming at least a portion of the peripheral edge of said passenger's area, a cowling portion supported from said hull by a linkage system for relative movement from a first position wherein said cowling portion forms a continuation of said deck portion of said hull and encloses only a front portion of said passenger's area while still accommodating at least a passenger in said passenger's area and a second position elevated and spaced to the rear of said first position wherein said cowling portion forms at least in part a cover above a rear portion of said passengers area not covered when in said first position and exposing the area of said passenger's area enclosed when in said first position while still accommodating the passenger in the same position within said passenger area.

2. A watercraft comprised of a hull as set forth in claim 1 wherein the linkage system comprises a pair of spaced apart links.

3. A watercraft comprised of a hull as set forth in claim 2 wherein the passengers area contains a seat in which a passenger may be seated in either position of said cowling portion and the links are pivotally supported to the hull on the opposite sides of the said seat.

4. A watercraft comprised of a hull as set forth in claim 3 wherein the hull is defined by a pair of raised gunnels on opposite sides of the seat and to which the links are pivotally connected.

5. A watercraft comprised of a hull as set forth in claim 1 wherein there is provided a seat in the passengers area in which a passenger may be seated in either position of said cowling position and a watercraft steering control positioned forwardly of the seat.

6. A watercraft comprised of a hull as set forth in claim 5 wherein the watercraft steering control and the seated passenger's legs are covered by the cowling portion when in its first position.

7. A watercraft comprised of a hull as set forth in claim 5 wherein the watercraft steering control is carried by the cowling portion and the seated passengers legs are covered by the cowling portion when in its first position.

8. A watercraft comprised of a hull as set forth in claim 1 further including a recessed area formed in the hull in which the cowling portion nests and further including seal means for sealing the cowling portion to the hull when in it first position.

9. A watercraft comprised of a hull as set forth in claim 1 wherein the passengers area comprises a seat in which a passenger may be seated in either position of the cowling portion and a foot area positioned forwardly from the seat and wherein the cowling portion covers the foot area when in its first position.

10. A watercraft comprised of a hull as set forth in claim 9 wherein the deck portion is formed forwardly of said foot area and elevated relative to the foot area.

11. A watercraft comprised of a hull as set forth in claim 10 wherein the cowling portion further covers at least a portion of the deck portion when the cowling portion is in its first position.

12. A watercraft comprised of a hull as set forth in claim 1 wherein the linkage system comprises a pair of spaced apart links.

13. A watercraft comprised of a hull as set forth in claim 12 wherein the links are pivotally supported to the hull on the opposite sides of the said seat.

14. A watercraft comprised of a hull as set forth in claim 13 wherein the hull is defined by a pair of raised gunnels on opposite sides of the seat and to which the links are pivotally connected.

15. A watercraft comprised of a hull as set forth in claim 14 wherein a watercraft steering control is positioned forwardly of the seat.

16. A watercraft comprised of a hull as set forth in claim 15 wherein the watercraft steering control and the seated passenger's legs are covered by the cowling portion when in its first position.

17. A watercraft comprised of a hull as set forth in claim 15 wherein the watercraft steering control is carried by the cowling portion.

18. A watercraft comprised of a hull as set forth in claim 17 wherein the deck portion has sufficient length so as to accommodate a rider entering the passenger's area when the cowling portion is in its second position.

19. A watercraft comprised of a hull as set forth in claim 15 wherein the deck portion has sufficient length so as to accommodate a rider entering the passenger's area when the cowling portion is in its second position.

20. A watercraft comprised of a hull as set forth in claim 14 wherein the deck portion has sufficient length so as to accommodate a rider entering the passenger's area when the cowling portion is in its second position.

21. A watercraft comprised of a hull as set forth in claim 10 wherein the deck portion has sufficient length so as to accommodate a rider entering the passenger's area when the cowling portion is in its second position.

* * * * *